United States Patent [19]

Perry

[11] Patent Number: 4,714,053

[45] Date of Patent: Dec. 22, 1987

[54] WATER HEATER CLEANING APPARATUS

[76] Inventor: Richard C. Perry, 905 Linden Ct., Western Springs, Ill. 60558

[21] Appl. No.: 888,352

[22] Filed: Jul. 23, 1986

[51] Int. Cl.[4] ..... F22B 37/50; F22B 37/52

[52] U.S. Cl. ..... 122/382; 122/159; 122/390; 122/405; 134/166 R

[58] Field of Search ..... 122/13 R, 17, 159, 406 R, 122/408 R, 379, 380–383, 388, 390, 392, 405, 361; 126/344, 361; 165/95; 134/166 R, 171

[56] References Cited

U.S. PATENT DOCUMENTS

| | | | |
|---|---|---|---|
| 277,012 | 5/1883 | Dinkel | 122/390 X |
| 641,295 | 1/1900 | Jackson | 122/405 X |
| 1,028,180 | 6/1912 | Bayer | 122/392 |
| 1,185,576 | 5/1916 | Baker | 122/379 X |
| 1,582,148 | 4/1926 | Stockholder | 122/381 |
| 1,696,005 | 12/1928 | Kothe | 122/405 X |
| 1,767,919 | 6/1930 | Eiermann | 122/405 |
| 1,768,039 | 6/1930 | Eiermann | 122/405 |
| 2,024,564 | 12/1935 | Brand | 122/405 |
| 2,137,253 | 11/1938 | Thompson | 122/392 |
| 2,290,368 | 7/1942 | Dutton | 122/405 |
| 2,809,267 | 10/1957 | Schauer, Jr. | 122/13 R |
| 4,257,355 | 3/1981 | Cook | 122/390 X |
| 4,263,879 | 4/1981 | Lindahl | 122/159 |
| 4,505,231 | 3/1985 | Syler | 122/383 X |
| 4,527,543 | 7/1985 | Denton | 122/361 |
| 4,566,406 | 1/1986 | Appleman | 122/383 X |

*Primary Examiner*—Albert J. Makay
*Assistant Examiner*—Steven E. Warner
*Attorney, Agent, or Firm*—Wallenstein, Wagner, Hattis, Strampel & Aubel, Ltd.

[57] ABSTRACT

An apparatus for cleaning a residential water heater 10 or the like without the need for draining and re-filling the tank. The water heater is generally vertically disposed and has a cylindrical side wall 12, a top 14, and a bottom 16. A water supply tube 20 terminates in a nozzle 22 which permits entry of a stream of water 24 in a generally horizontal spray pattern along the bottom to flush and agitate any foreign matter 38 along the bottom. A drain cock 28 is provided within the heater side wall and opposite the nozzle, the drain cock being opened upon flushing of the bottom of the water heater so that any foreign matter is removed through the drain cock. In lieu of a simple, single-orificed nozzle, a multiple-orifices nozzle **22*b*** or a plurality of nozzles may be provided.

5 Claims, 8 Drawing Figures

WATER HEATER CLEANING APPARATUS

BACKGROUND OF THE INVENTION

1. Field of the Invention

The invention relates to commercial and residential water heaters, and more particularly to an apparatus for cleaning such water heaters by the introduction of a stream of high-velocity water in a generally horizontal spray pattern across the bottom of the heater tank and the simultaneous opening of tank drain means diametrically opposed to the stream of water to permit removal of that foreign matter without the necessity of draining and refilling the tank.

2. Description of the Prior Art

A problem in the commercial and residential water heater industry is the accumulation of scale and other foreign matter along the bottom of water heater tanks. This accumulation of scale effectively shortens the life of such water heaters because the scale acts as an insulator, causing the tank metal to overheat and burn out. One device for cleaning water heaters is described in U.S. Pat. No. 4,263,879, issued to Lindahl on Apr. 28, 1981. Lindahl provides a tubular member along the bottom of and within a water heater tank. The tubular member has a plurality of small openings through which vertical and horizontal streams of water are directed upward and along the tank bottom. However, Lindahl merely appears to be directed to the prevention of settling of scale and other foreign matter on the bottom of the tanks. The Lindahl provisions for removal of solid materials from the tank do not include drain means or the like. Rather, the streams of water agitate and suspend the foreign matter within the heater, which is then passed out through the top of the tank along with the heated water.

U.S. Pat. No. 277,012, issued to Dinkel on May 8, 1833, discloses a substantially vertically-directed spray of a sugar-water solution to clean crystallized sugar crystals on tubes in a distillation apparatus. Dinken apparently does not disclose means for cleaning sediment at the bottom of a tank.

In contrast, U.S. Pat. Nos. 1,767,919 and 1,768,039, both issued to Eiermann on June 24, 1930; and U.S. Pat. No. 2,024,564, issued to Brand on Dec. 17, 1935, all disclose a means of cleaning the bottom of residential hot water tanks. However, each of these patents require that the tank first be drained, and then cleaned by introducing a cleaning spray from above and onto the bottom of the tank. For example, the Eiermann '919 reference discloses at page 2, lines 54–65, that although the inflow of water from the top of the cold water tube is usually sufficient to clean the bottom of the water heater, the removal of accumulated sediment should be effected by draining the heater, turning the water on so that it will spray the bottom of the heater, and then refilling the heater for normal operation. Similarly, the Eiermann '039 reference indicates at lines 68–85 substantially this same mode of operation. Finally, Brand indicates at page 1, column 2, lines 14–16, that when it is desired to clean the heater, the water contained within that heater is drained off through a drain cock 16. Several other patents in the water heater or related arts include U.S. Pat. Nos. 641,295, issued to Jackson on Jan. 16, 1900; 1,028,180, issued to Bayer on June 4, 1912; 1,582,148, issued to Stockholder on Apr. 27, 1926; 1,696,005, issued to Kothe on Dec. 18, 1928; 2,137,253, issued to Thompson on Nov. 22, 1938; 2,290,368, issued to Dutton on July 21, 1942; and 4,527,543, issued to Denton on July 9, 1985.

SUMMARY OF THE INVENTION

The present invention is an apparatus for cleaning a conventional residential or commercial water heater, typically being of a cylindrical shape and having a circular top and bottom. The apparatus includes a water supply source or tube, and further includes water-discharging means for permitting a high-velocity flushing or sweeping stream of water from the water supply source onto the bottom and within the interior of the water heater. The water-discharging means is disposed adjacent the bottom of the water heater and provides its water stream in a generally horizontal pattern across the bottom to dislodge scale and other foreign matter. Tank drain means are provided, which are diametrically opposed to the water-discharging means, and which effectively permit the removal of the dislodged scale and foreign matter from the tank while the tank is being flushed with water flowing through the water-discharging means. The water supply source can be conventional piping which enters the tank through the top, the side wall, or any other convenient portion of the tank. The water-discharging means may comprise a nozzle having one or more orifices. The invention is suitable for water heaters having either flat or convex bottoms.

DESCRIPTION OF THE PREFERRED EMBODIMENT

Figure 1:
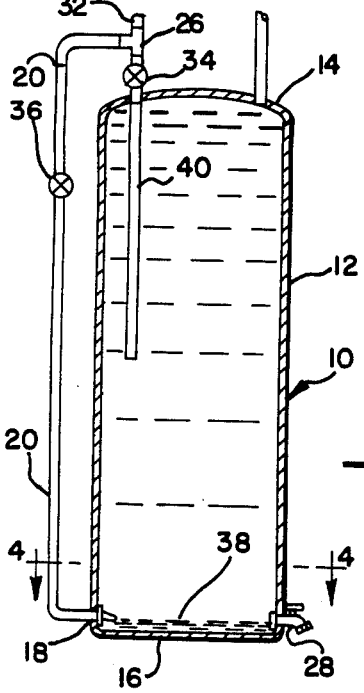
FIG. 1 is a vertical section view showing the water-discharging means entering the side of the tank in accordance with the invention.
Figure 3:
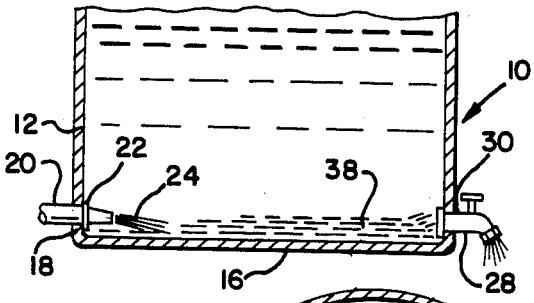
FIG. 3 is an enlarged view of the lower portion of the water heater shown in FIG. 1, but with the stream of water flowing through the nozzle.
Figure 4:
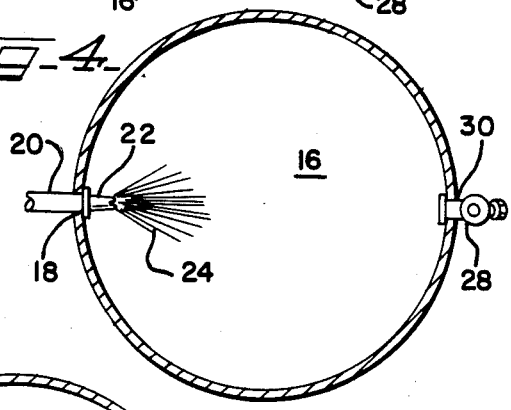
FIG. 4 is a sectional view taken along line 4—4 of FIG. 1.

Referring now to the drawings, FIGS. 1–8, the water heater 10 is generally vertically disposed and has a cylindrical side wall 12, a circular top 14, and a circular bottom 16. The top and bottom are normally welded to the cylindrical side wall to form a water-tight unit.

In the embodiment shown in FIGS. 1, 3, 4, 6, 7, and 8, the water heater 10 is provided with a first opening 18 in the side wall adjacent the flat 16 or convex **16*a* tank bottom. A water supply tube 20 enters the tank at this first opening 18. The tube 20 terminates at a nozzle 22 or 22*b* which is configured to provide a generally horizontal flow of water across the tank bottom 16 or 16*a***.

The nozzle directs a stream of water 24 across the tank bottom in a generally horizontal spray pattern to facilitate the flushing of any scale or foreign matter accumulated along the bottom. A drain cock or the like 28 may be provided diametrically opposed to, i.e., substantially across from, the first opening 18. The drain cock enters the tank through a second opening 30 in the side wall 12. During normal operation of the water tank, this drain cock is left in a closed position. The nozzle may be one including either one orifice 22 or a plurality of orifices **22*b* as shown in FIGS. 3, 4, 6, 7, and 8**, respectively.

Figure 2:
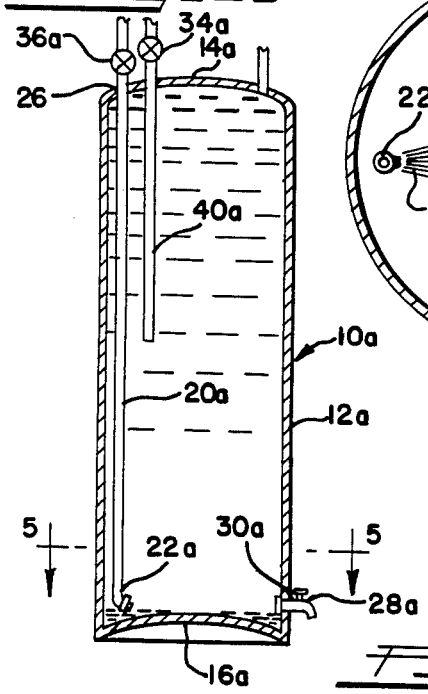
FIG. 2 is a vertical section view showing the water-discharging means entering the top of the tank and terminating near tne bottom of the tank in accordance with the invention.
Figure 5:
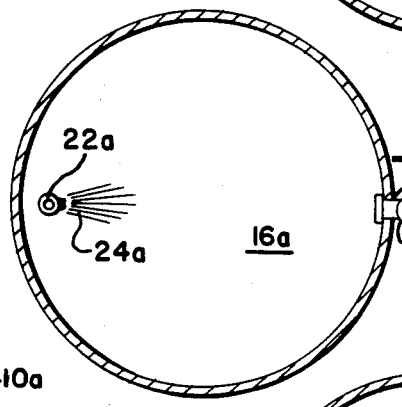
FIG. 5 is a sectional view taken along line 5—5 of FIG. 2.
Figure 6:
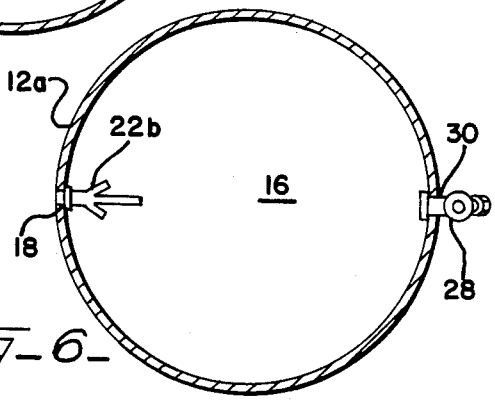
FIG. 6 is a sectional view of a water heater which includes a multi-orificed nozzle, or water-discharging means, adjacent the bottom of the water heater.
Figure 7:
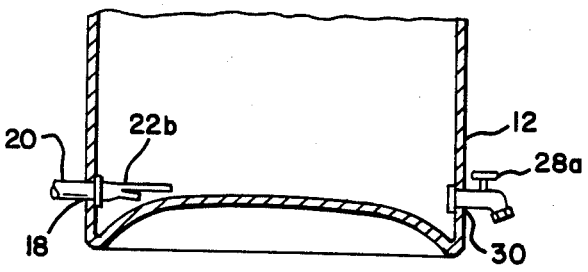
FIG. 7 is a horizontal view of the multi-orificed nozzle shown in FIG. 6.
Figure 8:
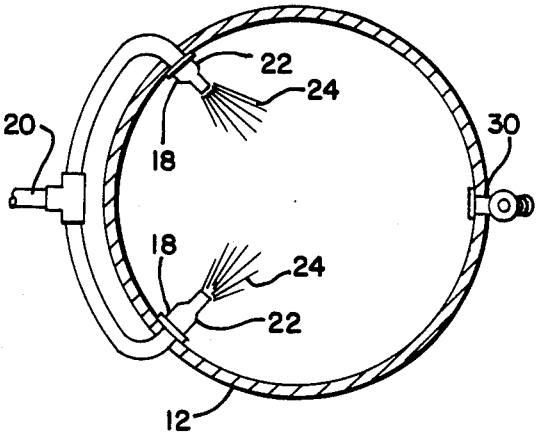
FIG. 8 is a sectional view which includes separate nozzles or water-discharging means entering the side of the tank at different locations.

Alternatively, the residential water heater may be of a configuration as shown in FIGS. 2 or 5. With this configuration, the water supply tube **20*a* enters the tank at the top 14*a* rather than through side wall 12*a*, and terminates in a nozzle 22*a* which is disposed adjacent the lower end of a tank 10*a* which is shown having a generally convex bottom 16*a*. The horizontal stream of water 24*a* passes across the uppermost portion of the convex bottom 16*a* where the greatest potential for damage from the accumulation of foreign matter exists. In a heater having a plurality of flue pipes, each of which reaches the tank bottom, extra nozzles could be provided for flushing between the flue pipes. What is most important is that the nozzles provide a substantially horizontal flow of water across the tank bottom in a direction towards the tank drain means 28 or 28*a***.

The operation of the novel water heater cleaning apparatus may best be understood by a review of the FIGURES and the accompanying text. The water within the water heater is heated by the hot gases and products of combustion passing through flue tubes (not shown) within the heater in a manner well-described in the prior art. The problem that the present apparatus seeks to alleviate is the tendency of various dissolved solid materials in the water within the heater to precipitate out of that water, and then accumulate at the bottom of the tank. If these precipitates are not periodically removed by some sort of tank cleaning system or regimen, the accumulation at the bottom of the tank will lower heating efficiency and can cause overheating, corrosion, and metal failure of the tank bottom.

A cold-water inlet tube 32 enters the top of the tank (FIG. 1) and provides a source of cold water through water-fill tube 40, to be heated in the tank 10. The inlet tube 32 and water-fill tube 40 are communicative with water supply tube 20 through a tee fitting 26. Under normal operation, manually-actuated valve 34 in water-fill tube 32 is open, and valve 36 in water supply tube 20 is closed.

In contrast, when tank cleaning is desired, valve 34 is closed and valve 36 is opened. In this manner, as may be seen in FIG. 3, a stream of water 24 is discharged adjacent the bottom 16 of the water heater 10 in a generally horizontal spray pattern to flush and agitate any settled foreign matter. When valve 36 is opened, drain cock 28 is simultaneously opened so that as the stream of water carries the foreign matter 38 from the tank bottom 16 and towards the drain cock 28 which is diametrically opposed to the first opening, the scale and other foreign matter is discharged through the drain cock 28. Because of the spacing of the nozzle adjacent the tank bottom and the relative positioning of the discharge means or drain cock 28, the sediment can be removed without discharging the contents of the tank, as taught in many of the prior art patents cited above.

It will be understood by those skilled in the art that the manually-actuated valves 34 and 36 and drain cock 28 may be replaced by electrically-actuated valves or the like, which can be automatically controlled to provide for tank flushing at regular intervals. A pulsing flow of water to the nozzle could be used. Alternatively, water flow in the multi-orifice nozzle **22*b*** could be alternated through the various orifices.

What I claim is:

1. An apparatus for cleaning a residential or commercial water heater or the like without draining and refilling said heater, comprising a vertically-disposed water heater having a cylindrical side wall, a top, and a bottom; a first opening in said side wall and adjacent said bottom; a water supply tube which enters said first opening, said water supply tube terminating at a nozzle which permits entry of a stream of water in a generally horizontal spray pattern along said bottom for flushing and agitating any foreign matter along said bottom, and a drain cock within a second opening in said side wall and diametrically opposed to said first opening, said drain cock being open while flushing said tank bottom so that said foreign matter is removed through said drain cock.

2. The apparatus as set forth in claim 1, wherein said bottom is a flat bottom.

3. The apparatus as set forth in claim 1, wherein said bottom is a convex bottom.

4. The apparatus as set forth in claims 1, 2, or 3, wherein said nozzle includes a single orifice.

5. The apparatus as set forth in claims 1, 2, or 3, wherein said nozzle includes a plurality of orifices.

* * * * *